US009074855B1

(12) United States Patent
Frericks et al.

(10) Patent No.: US 9,074,855 B1
(45) Date of Patent: Jul. 7, 2015

(54) ASSEMBLABLE MODULE CHARGE SYSTEM

(71) Applicants: Lonnie Frericks, King George, VA (US); Thomas Higdon, LaPlata, MD (US); Michael D Lincoln, Litchfield, NH (US); Bob Brush, Virginia Beach, VA (US); Mitchell Hovenga, Virginia Beach, VA (US)

(72) Inventors: Lonnie Frericks, King George, VA (US); Thomas Higdon, LaPlata, MD (US); Michael D Lincoln, Litchfield, NH (US); Bob Brush, Virginia Beach, VA (US); Mitchell Hovenga, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/998,207

(22) Filed: Oct. 11, 2013

(51) Int. Cl.
*F42B 3/02* (2006.01)
*F42B 1/02* (2006.01)

(52) U.S. Cl.
CPC .... *F42B 3/02* (2013.01); *F42B 1/02* (2013.01)

(58) Field of Classification Search
CPC ..... F42B 1/032; F42B 1/028; F42B 3/02; F42B 1/02; Y10S 12/701; Y10S 12/705
USPC ..... 102/305–309, 311, 372, 493–495, 506, 102/705; 89/1.15
See application file for complete search history.

(56) References Cited

U.S. PATENT DOCUMENTS

| | | | | |
|---|---|---|---|---|
| 4,051,696 | A | 10/1977 | Mason et al. | |
| 4,382,409 | A | 5/1983 | Burns | |
| 6,973,878 | B2 * | 12/2005 | Lloyd et al. | 102/494 |
| 7,299,735 | B2 | 11/2007 | Alford | |
| 8,276,520 | B1 * | 10/2012 | Fong et al. | 102/493 |
| 2010/0018427 | A1 * | 1/2010 | Roland et al. | 102/305 |

OTHER PUBLICATIONS

HTTP://articles.janes.com/articles/Janes-Explosive-Ordnance-Disposal/Krakatoa-RT-Large-Point-Focal-Explosively-Formed-Projectile-Shaped-Charge-Kit-United-Kingdom.html.
http://en.wikipedia.org/wiki/Krakatoa_(explosive.
http://www.explosives.net/Products.aspx.
http://www.downwindmarine.com/Allslip-Internal-Slides-Nylon-Alloy-p-908911446.html.

* cited by examiner

*Primary Examiner* — Samir Abdosh
*Assistant Examiner* — John D Cooper
(74) *Attorney, Agent, or Firm* — Fredric J. Zimmerman

(57) ABSTRACT

The assemblable module charge system includes a set of quadrant panels, where an individual quadrant panel is a fractional component of a cylindrical wall having a plurality of external longitudinal parallel rails separated by channels. The fractional cylindrical wall has a sectional length with fastening side edges. The set of panels may be stored as a flat-pack and assembled into a single module. The volume of the flat-pack is less than half the volume of the assembled module. The flat-pack is a group of unassembled quadrant panels nested to minimize space. The system uses elongate slides that may be frictionally positioned in channels shared by the module and a charge system. The charge system is a prepackaged explosive that may be fastened to the assembled module.

8 Claims, 10 Drawing Sheets

ASSEMBLABLE MODULE CHARGE SYSTEM

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to explosive tools, and more particularly to an assemblable module charge system of explosive tools that condenses the complexity, size and weight of available multiple explosives and explosive tools into the assemblable module charge system.

2. Background

The US Army's special operations forces have performed demolition operations dating back to pre-World War II using bulk explosives and non-standard, improvised methods. Soldiers have used materials found in the field such as junk yard scrap, glass champagne bottle bottoms and steel plates and molded the explosive to them in an attempt to increase the efficiency of the charges for specialized missions. Since the advent of munitions incorporating explosively formed penetrators and projectiles (EFPs) as warheads, the special operations forces have learned to build demolition charges using this technology. Often times, through trial and error, the mission succeeded using the improvised demolition charges to neutralize the target. However, improvised EFPs are rarely optimized nor do they have consistent and reliable performance because of the variability in materials and building techniques employed.

To overcome some of these deficiencies, demolition kits have been developed for the Navy and the Army operations. Typically, a kit has included a collection of inert metal and plastic parts, and commercially available items that give soldiers a wide selection of warheads and attachment devices, which can be tailored to neutralize a specific target. Many kits, have various warheads, at least three sizes of conical shaped charges, and four sizes of linear shaped charges, where the relative dimensions stay about the same, but the size is just increased. As the kits have evolved to have greater capabilities, so has the weight. The warheads, which are provided, have a pre-set configuration that contains all materials, except the explosive. The explosive still has to be packed into the warheads. Currently, the demolition kit also has inert components to tailor-make various explosive charges and devices to attach or aim these charges at the target.

In the last friendly area near the mission jump-off site, the user will select the proper sized warheads and hand pack the warheads with a moldable explosive. The armed warheads are manually carried in a backpack to the target site.

SUMMARY OF THE INVENTION

The disclosed invention, in one aspect, is an assemblable module charge system (AMCS) that is uniquely suitable to be utilized in dismounted operations (particularly explosive ordnance disposal operations), where dismounted operations require potentially everything to be manually carried, for instance in a backpack. It is anticipated that there are no particular size limitations, but that some sizes are more easily handled without mechanical assistance, either for larger or smaller modular charge systems. The invented system enables a relatively small suit of devices to allow assembly of multiple types of charges, including shape charges (SC), explosively formed projectiles (EFPs), explosively driven flyer plates (FPs), contact charges (CC), linear shape charges (LSC), strip charges (STRPC), and other explosive tools, such as those employed to breach an obstacle. The invented system condenses and consolidates the capabilities available from multiple explosives and explosive tools into a substantially relatively lightweight suit of devices, which is suitable for dismounted operations.

The assemblable module charge system includes an assemblable module, which may be assembled in the field. The assemblable module may be fitted with a flying plate, a liner or other hardware, and may be, axially coupled to other modules therein configuring the size and type of charge. The assemblable module, in one exemplary embodiment, is a set of quadrant panels, where an individual quadrant panel is a fractional component of a cylindrical wall, where the fractional cylindrical wall has a sectional length with fastening side edges. The set of panels are light enough to be manually carried and stored as a flat-pack and assembled into the module, where at least one of the two side edges of the quadrant panel is attached to a side edge of at least one adjacent panel. The flat-pack is a group of unassembled quadrant panels, where the panels are nested to minimize space. When assembled into a substantially cylindrical module the module occupies at least twice the volume of a flat-pack having four panels.

Another exemplary aspect of the invention is a charge system, that is, a prepac, where the prepac, includes an explosive or combination of explosives prepackaged in a cylindrical retainer and rear plate. The prepac has a plurality of external longitudinal rails that align with the plurality of external longitudinal rails on the assembled module, and elongate slides may be used to connect the prepac to the assembled module.

The assemblable module may be used alone or in combination with multiple other compatible modules.

The aligned rails themselves serve as a, sighting mechanism, and additionally enable the mounting of various ancillary sighting devices, and therefore various configurations of the assemblable module charge system may be effectively aimed. Examples of ancillary sighting devices, include, a gun sight (front, rear, flip-up), scope sights on a Picatinny rail, such as a Trijicon Tall Picatinny Rail Mount, and using a stand, such as a tripod, where the stand has a sighting mechanism. The system enables substantially all of the several shape charge configurations to be held at a fixed distance from a target.

An important aspect of the invention is that for a given suit of tools, where various liners, igniters and other components are also considered tools, the modules are standardized. Standardization includes size, morphology, and partitioning of the explosive therein to enable an assemblage of multiple types of charges to be configured to have a range of total weight of explosive, even though the size of an individual assemblable module remains the same. Exemplary types of charges include: shape charges (SC), explosively formed projectiles (aka penetrators) (EFPs), explosively driven flyer plates (FPs), contact charges (CC) for cutting, linear shape charges (LSC), strip charges (STRPC), and multiple explosive types of charges for breaching obstacles.

The assemblable module may be modified in the field to have variations in the shape and the amount of the explosive, so as to meet the needs for the mission.

In substantially all scenarios the modular system includes an access port for a shock tube, blasting cap or other igniter, where the access port is located in a quadrant panel of a flat-pack or in a rear plate of a prepac.

BRIEF DESCRIPTION OF THE DRAWINGS

The foregoing invention will become readily apparent by referring to the following detailed description and the appended drawings in which.

DETAILED DESCRIPTION OF THE INVENTION

The assemblable module charge system includes an assemblable module that may be assembled in the field. The assemblable module may be fitted with a flying plate, a liner or other hardware and may be axially coupled to other modules therein configuring the size and type of charge. The assemblable module, in one exemplary embodiment, is a cylindrical casing having rails, where the casing may be quickly assembled in the field from a set of quadrant panels. An individual quadrant panel is a fractional component of a cylindrical wall, where the fractional cylindrical wall has a sectional length with fastening side edges. The set of panels are light enough that to be manually carried and stored as a flat-pack and assembled into the module, where at least one of the two side edges of the quadrant panel is attached to a side edge of at least one adjacent panel. The flat-pack is a group of unassembled quadrant panels, where the panels are nested to minimize space. When assembled into a substantially cylindrical module, the module occupies at least twice the volume of a flat-pack having four panels. In general, assuming a constant wall thickness (r(outside)−r(inside))=c, the larger the assemblable module then the greater the percent savings in space achieved utilizing flat-packs. The approximate volume of the flat-pack is $\pi L(r^2(\text{outside}-r^2(\text{inside}))$, and the volume percent of the flat-pack compared to the the assembled module is about $(1-(r^2(\text{inside})/r^2(\text{outside})))*100$, where $\pi$ is pi, L is the length of the module, r(inside) is the inside radius, and r(outside) is the outside radius.

Figure 3:
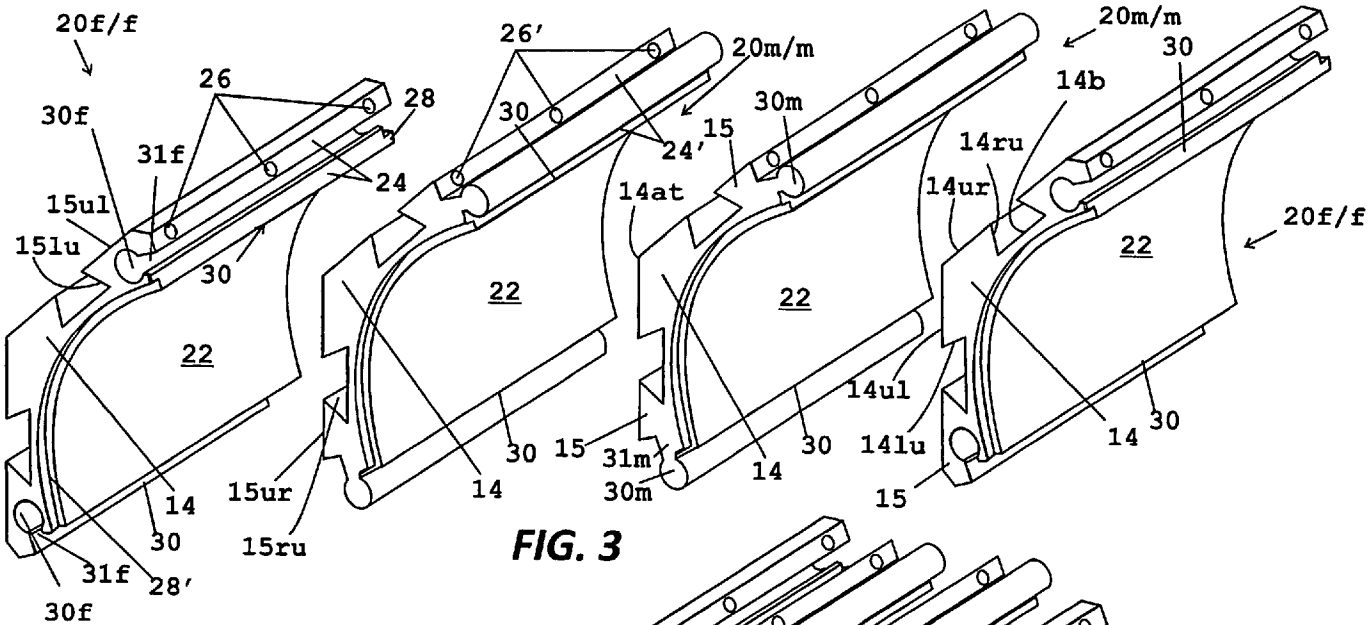
FIG. 3 is a perspective view of four individual quadrant panels having rails, where each panel is a fractional component of a cylindrical wall having a sectional length with fastening side edges. The set may be stored as a flat pack and assembled into the modular casing illustrated in FIG. 1, where, as shown a side edge of one panel is attached to a side edge of an adjacent panel.
Figure 3A:
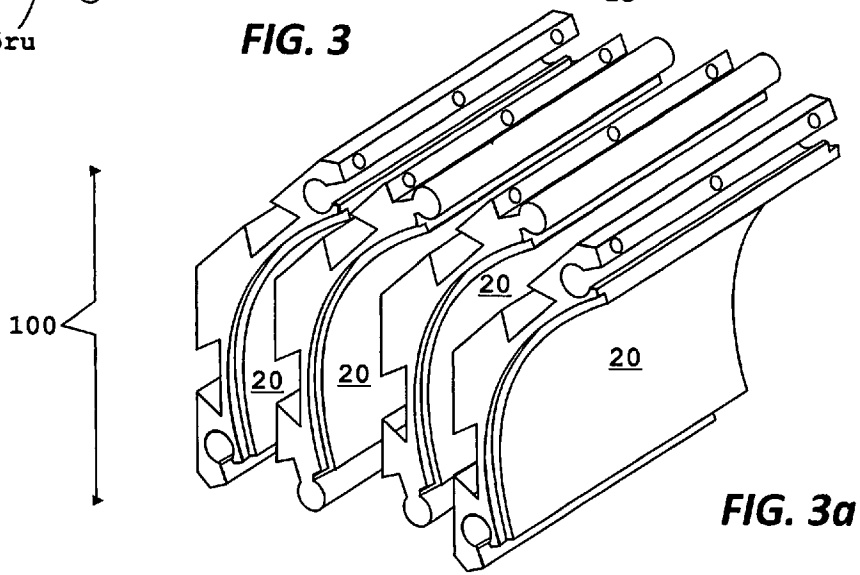
FIG. 3*a* is a perspective view of a flat-pack containing four quadrant panels that are stacked to minimize volume.

A flat-pack 100 is shown in FIG. 3*a*. In the illustrated flat-pack 100 four panels 20 are shown, without any packaging. Flat-packs may be carried in kits for special operations, and a user's preference generally determines how the panels are bound. Other contents of the kit may influence a preference. For example, a kit contain an explosive where the explosive has a plasticizer, which could potentially weaken a packaging material, like a plastic shrink wrap. Many kits have several types of pressure sensitive tape, including polyimide, PVC and duct tapes for fastening devices. A specific tape or band could be wrapped around the flat-packs. Bands, such as rubber bands and cable bands are often included, and could be selected at the discretion of the user for the kit. FIG. 3 is an expanded flat-pack. Each of the illustrated panels 20 has a fractional perimeter wall 22. Further, each full rail 14 includes multiple sides including an upper left side 14*ul*, an upper right side. 14*ur*, a left under side 14*lu*, a right under side 14*ru*, and a bottom 14*b* that is contiguous with the fractional perimeter wall 22 of the panel 20. In contrast to conventional rails, which have a flat upper surface, the upper left side 14*ul* and the upper right side 14*ur* of the rails are sloped. The upper left side and the upper right side intersect forming an apical edge 14*at* on each whole rail 14. In stark contrast to spline-like rails, the left under-side 14*lu* and the right under-side 14*ru* of each of the casing's rails are undercut, each under-side forming a sloped undercut surface. The apical top edge 14*at* is intrinsically a sighting device.

Individual panels 20 have a pair of parallel straight sides 30 contiguous with overlying partial rails 15. The partial rails 15 are complementary, such that when a side on one panel is fastened to an adjacent panel together the overlying partial rails 15 form a whole rail 14. As with the full rails, a pair of partial rails 15 includes multiple sides including an upper left side 15*ul*, a upper right side 15*ur*, a left under side 15*lu*, a right under side 15*ru*, and a bottom 14*b*, which is contiguous with the fractional perimeter wall 22 of the panel 20.

Additionally, the partial rails 15 generally have a pair of flat set-back edges 24' that frame a neck portion 31*m* of a necked rod 30*m*; and a pair of matching flat set-back edges 24 that frame a slot portion 31*f* of a slotted tubular channel 30*f*, where the slot portion 31*f* receives the neck portion 31*m*, and the slotted tubular channel 30*f* receives the necked rod 30*m* as it is slid into side edge 30 of an adjoining second quadrant panel. The surface of the set-back edges 24' has friction bumps 26' that will snap into depressions 26 on the surface of the set-back edges 24 when friction bumps 26' are aligned with depressions 26. The depressions and bumps may be on either surface, so long as they are opposing. Each panel has a front edge 28' and a rear edge 28 (see FIG. 3, top left panel)

Of the four panels 20 illustrated in FIG. 3, the center two panels are male/male panels 20*m/m* and the outer two panels are female/female panels 20*f/f*. A panel is termed a male/male panel 20*m/m* when both of the side edges 30 have a necked rod 30*m*, and the panel is termed a female/female panel 20*f/f* when both of the side edges 30 has a slotted tubular channel 30*f*. Panels are joined by sliding the necked rod 30*m* on one quadrant panel 20 into the slotted tubular channel 30*f* on side edge 30 of an adjoining second quadrant panel. A male/male panel only may be joined to a female/female panel.

Figure 4A:
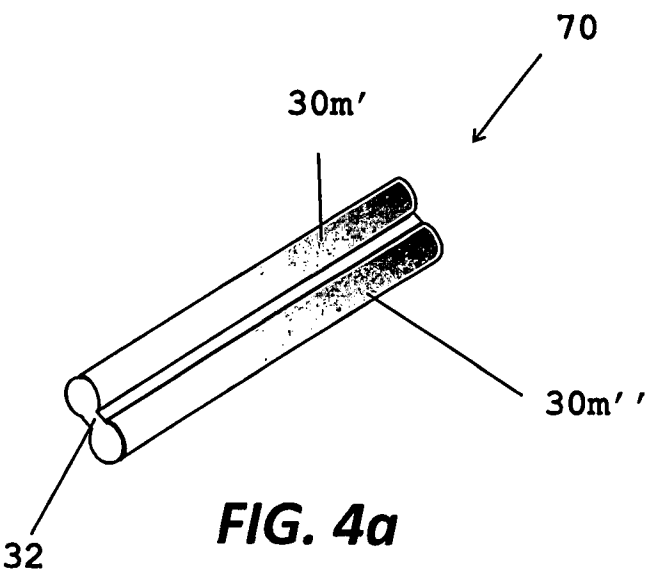
FIG. 4*a* is a perspective view of a double rod extension that may slide into a slotted tubular channel on side edge to convert a female connector to a male connector therein making it easier to secure an angle bar on a linear charge.
Figure 4:
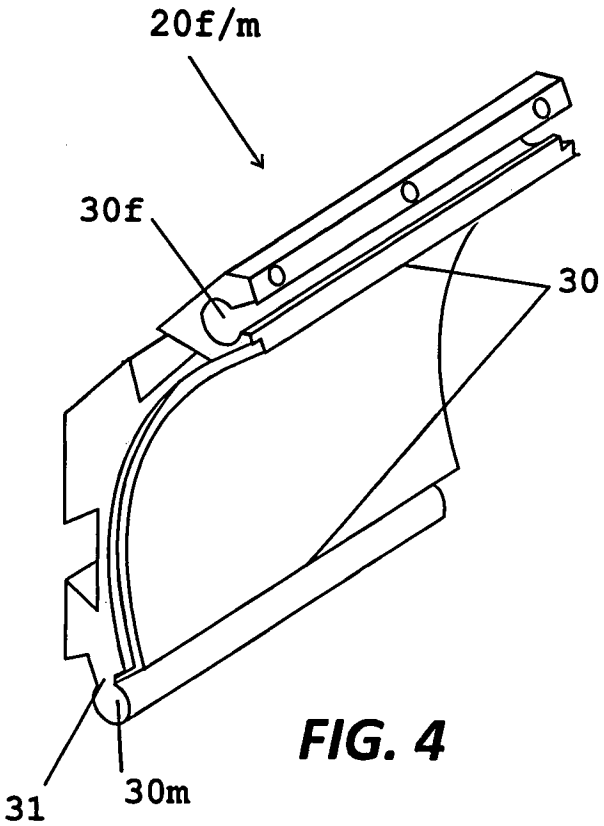
FIG. 4 is a perspective view of a quadrant panel with rails having a sectional length with fastening side edges. One of the side edges has a necked rod that can slide into a side edge of an adjoining second quadrant panel, and an opposing fastening edge has a slotted tubular channel that may receive a necked rod on a side edge of an adjoining third quadrant panel, and a fourth quadrant panel that may connect to edges of the second and third quadrant panels therein completing the assembly of the modular casing.

Another possible exemplary arrangement, as illustrated in FIG. 4, is a male/female panel (aka female/male panel) 20*f/m*, where one side edge 30 has a slotted tubular channel 30*f* and the other side edge 30 has a necked rod 30*m*. An advantage of the male/female panel 20*f/m* is that the cylindrical module may be assembled using any four male/female panels 20*f/m*, whereas, as shown in FIG. 1 and FIG. 2, using the male/male panels and female/female panels requires two of each type of panel.

Figure 1:
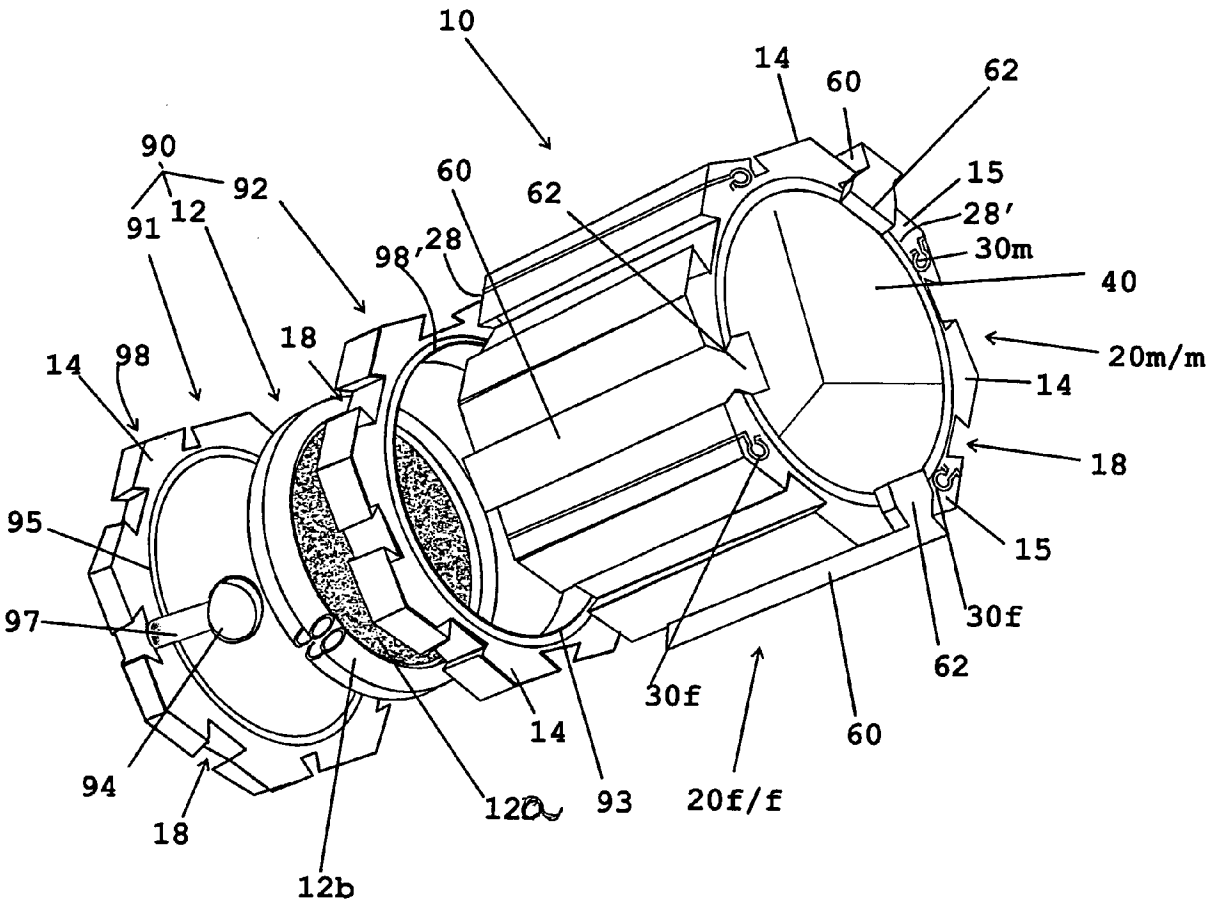
FIG. 1 is a partially exploded view of an exemplary embodiment of an assemblable module charge system, that is, an integrated combination of shaped charges and hardware, where a common component of the system is an assemblable module with rails that may be quickly assembled in the field from a set of quadrant panels. Each module may be combined with one or more additional modules and modular components, the combination producing an assortment of types of explosive charges, including the illustrated shape charge (SC), explosively formed projectiles (EFPs), linear charges (LC), and others that are specific for special operations in the field.
Figure 2:
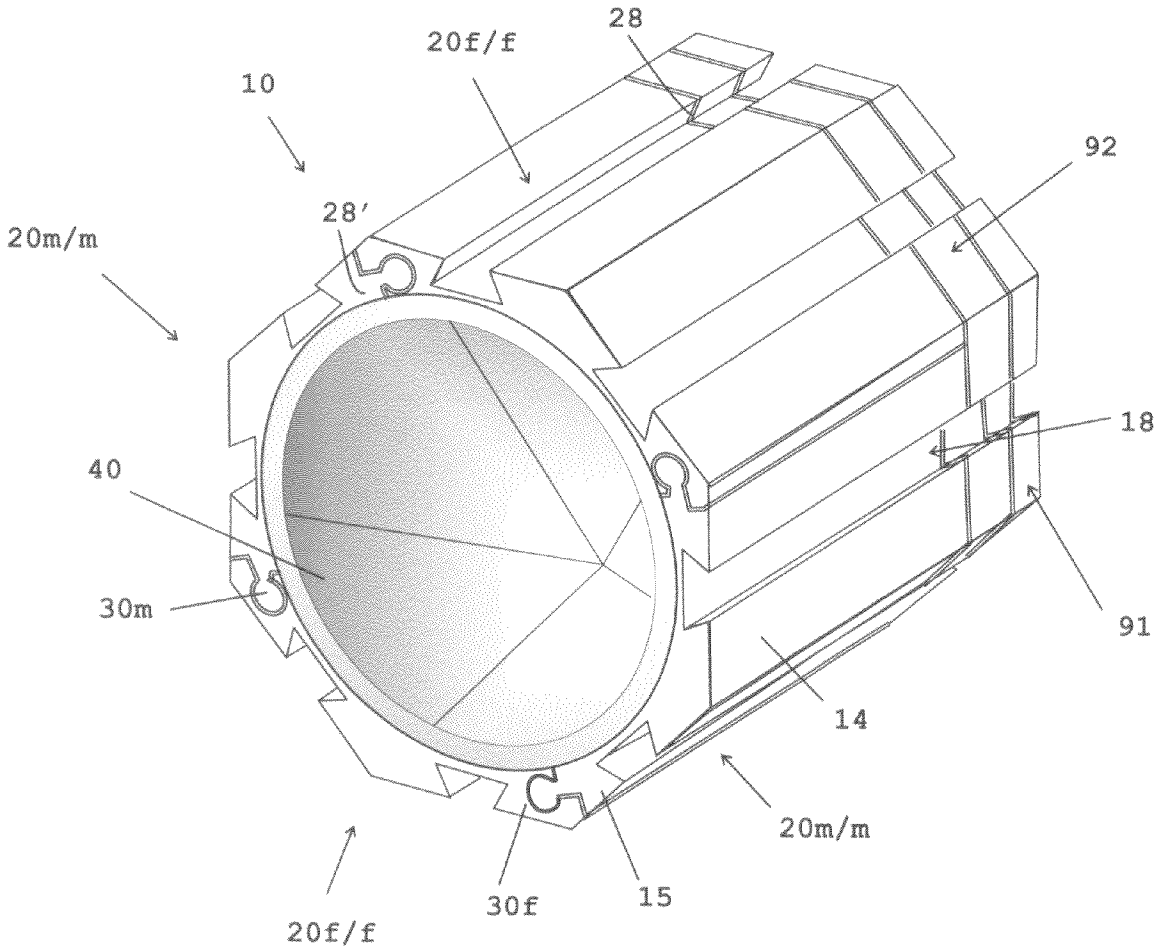
FIG. 2 is a perspective view of the assemblable module charge system having a conical liner as shown in FIG. 1, where the charge is attached as a prepac. The prepac is a modular container with rails that may contain a secondary explosive, generally one with a very high burn velocity (greater than or equal to about 5,900 m/s for example detonation chord) coiled around a primary explosive, and a rear panel with rails having an access port for an igniter, such as a blasting cap or other igniter, and, as illustrated, where the system includes elongate slides that may be used to join modules, liners, plates, and serve as standoffs.
Figure 8:
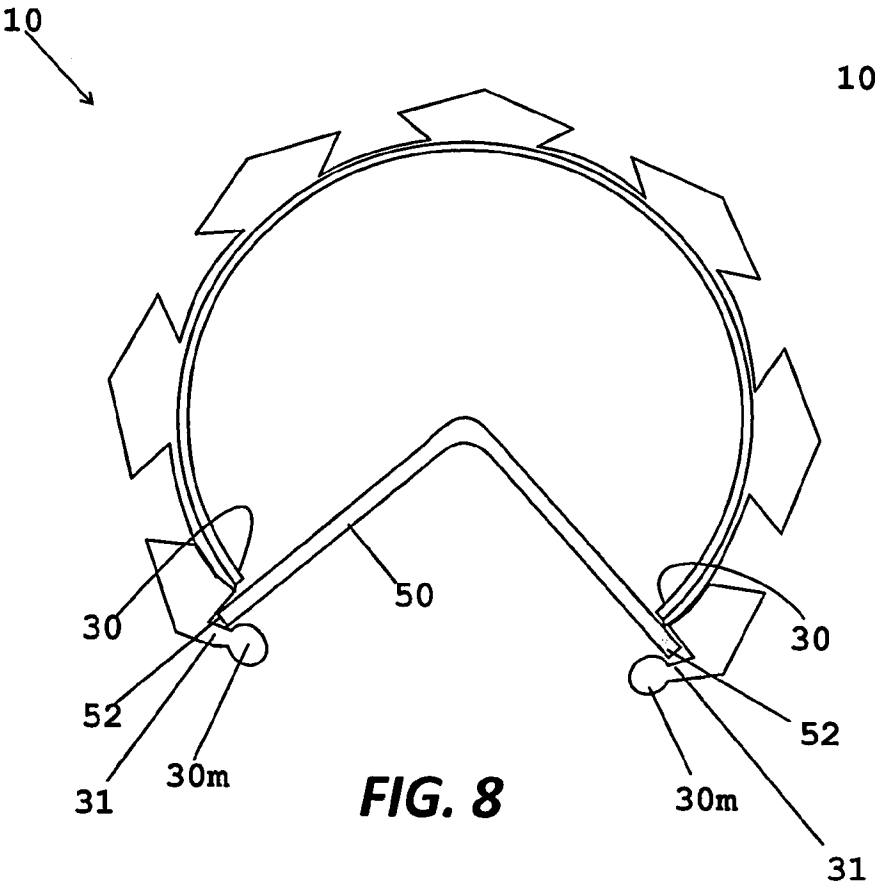
FIG. 8 is an end-on view of the linear shape charge (LSC) module shown in FIG. 7, with exception at least two of the side edges of opposing quadrant panels that restrain the angle bar have a combination of both a necked rod and a slotted tubular channel, and the combination accommodates thicker angle bars for more powerful linear charges; HRE

The advantage of using two male/male panels 20*m/m* and two female/female panels 20*f/f*, as shown in FIG. 1 and FIG. 2 is that in addition to assembling them into a cylindrical module, the module also may be assembled as a linear charge, where one of the female/female panels 20*f/f* is replaced with a common angle bar as shown in FIG. 8. The ends 52 of the angle bar 50 are lodged against the neck 31 of the rod 30*m*. In preparing the linear charge, the assembled cylindrical module is filled with explosive. The angle bar is aligned with the female/female panel 20*f/f*, and pushed in, simultaneously cutting away a wedge of explosive and pushing out the female/female panel 20*f/f* as the bar is slid into position. Configuring the module into a linear charge using the common angle bar requires that the angle bar be lodged against the neck 31 of the rods 30*m*, which extend from a pair of opposing panels.

Figure 7:
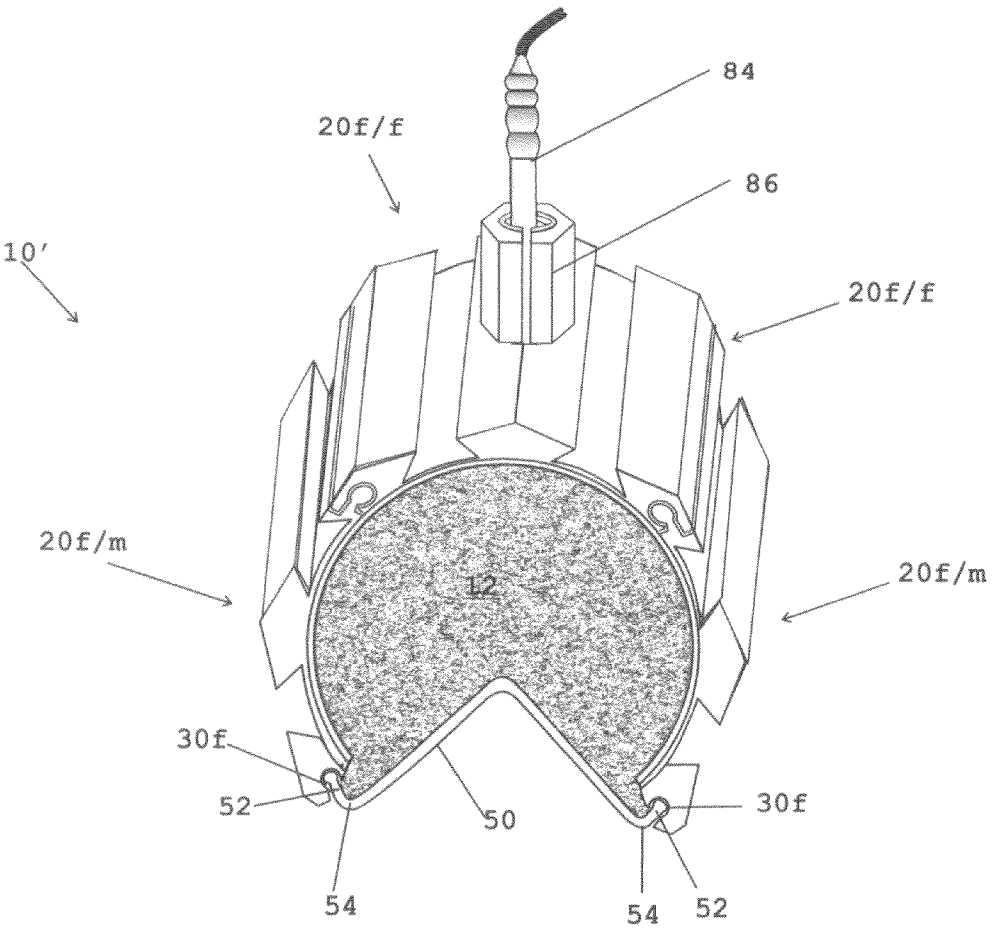
FIG. 7 is a perspective elevated side view of a linear shape charge (LSC) module filled with explosive. The module, is assembled utilizing flat pack quadrant panels, where one of the panels replaced with an altered angle bar, a top panel is fitted with a receptacle receiving an initiator, and a pie shaped wedge of the explosive is removed therein imparting shape to the linear charge.

As shown in FIG. 7, the linear charge module 10' has a three quarter pie shape explosive 12. A wedge of explosive has been removed. A male/male quadrant panel 20*m/m* has been removed from the module 10', and there are only two slotted cylinders 30*f* remaining. The module now has two female/male panels 20*f/m* and one female/female panel 20*f/f*. There are no necked rods 30*m* against which the angle bar may abut or interlock, only slotted tubular channels 30*f*. The linear charge may still be used, but the angle bar 50 must be altered to simulate a necked rod. The edges 54 of the ends 52 of the angle bar 50 have been bent and widened so that the angle bar may slide into the slotted tubular channel 30*f*.

A potentially more elegant solution is shown in FIG. 4*a*. A prosthetic double rod extension 70 is shown, where the prosthetic extension 70 includes two faux rods, 30*m*' and 30*m*", connected by a common neck 32. In application, one of the faux rods is slid into the slotted tubular channel 30*f* converting the female side edge into a male side edge with a necked rod 30*m*. There is no need to alter the angle rod 50. Additionally, as shown, the prosthetic double rod extension 70 makes it possible to use a single type of panel in the flat-pack, a female/male panel 20*f/m*, as any available slotted tubular channel may be filled with one of the faux rods 30*m*',30*m*" of the extension 70. A weakness of this approach is that the explosive is usually packed into a cylindrical module and a wedge is cut away as the angled bar is slid into position replacing a female/female panel. However this configuration would not be possible because, in the illustrated exemplary embodiment, a male/male panel was removed. The double rod extension 70 may still be used, but the explosive would have to be packed in the linear charge after the prosthetic double rod extension and angle bar were added to create the faux necked rods.

Other applications are anticipated, for example, connecting female/female panels together. Taken to the next level, the flat-packs may contain only female/female panels and enough prosthetic double rod extensions 70 to assemble them. As illustrated in FIG. 3, a downside is that the friction bumps 26' will not snap into depressions 26 on the surface of the set-back edges 24, 24', as there be a dearth of friction bump or depressions.

As illustrated in FIG. 1, a single assemblable module 10 is fitted with a charge system, that is, a prepac, where the prepac includes an explosive or combination of explosives that is prepackaged in a cylindrical retainer and rear plate. A prepac 90 having an, explosive charge 12, which includes primary explosive 12*a*, for example C4, where C4, more particularly, is RDX (a.k.a.; cyclonite or cyclotrimethylene trinitramine). The weight balance of C4 includes a plasticizer, a binder that is generally polyisobutylene, and a small amount of oil. The prepac 90 may also include a secondary explosive charge 12*b*, which includes one or more detonation chords that substantially encircle the primary explosive 12*a*. Detonation chord burns at a high velocity, and it ensures that the entire primary explosive is detonated at the same time. The prepac 90 further includes a rear plate 91 with a circular groove 95, which receives a shallow cylindrical retainer 92. The rear plate 91 has an open groove 97 for communicating an impulse generated by an igniter to the perimeter of the explosive 12, and in particular a detonation chord 12*b*. The rear plate 91, the retainer 92 and the assembled module have a plurality of external longitudinal rails 14 that run lengthwise, from a front edge 28' as shown in FIG. 1 and FIG. 3 to a rear edge 28 of the module 10. The external longitudinal rails 14 coextend from the front edge of the retainer 98' to a rear edge 98 of the prepac 90. The rails 14 are substantially parallel, and approximately equidistantly spaced. The space between a pair of rails defines a channel 18. See below for a more complete discussion.

Figure 11:
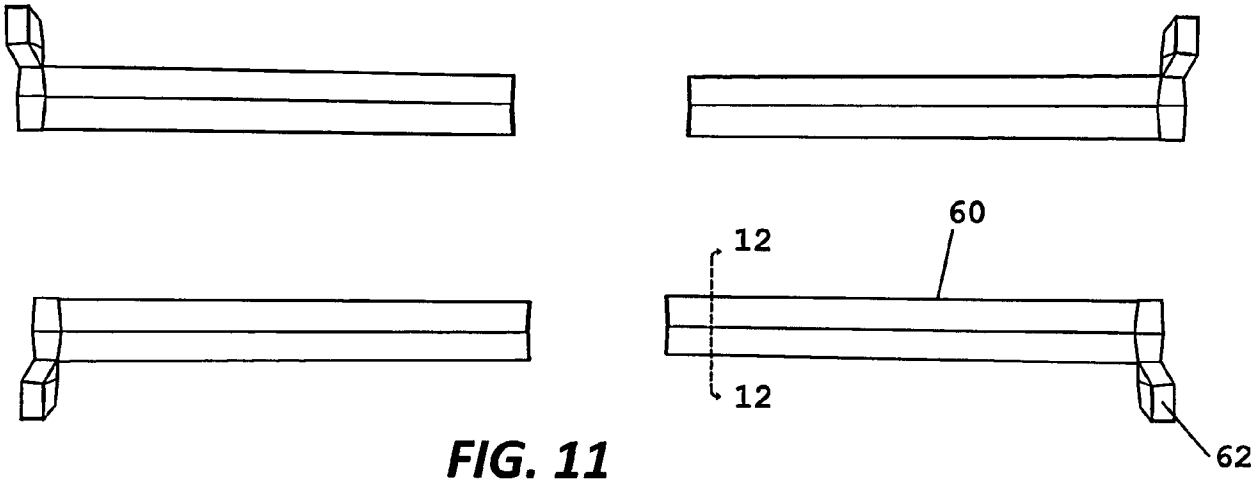
FIG. 11 is an assemblage of views of an elongate internal slide having an end with an L-shaped extension.
Figure 12:
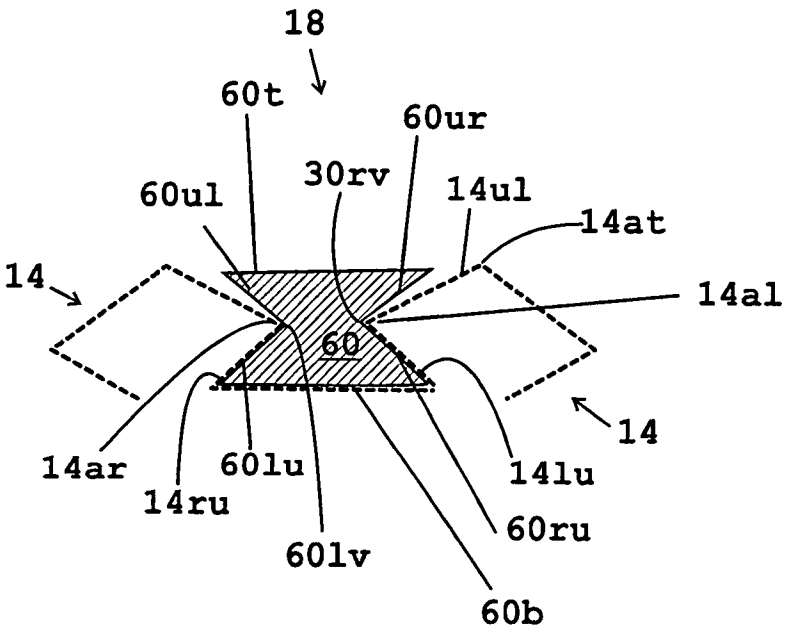
FIG. 12 is a cross-sectional view of an elongate internal slide taken along section line 12-12 of FIG. 11.

As shown in FIG. 1, elongate internal slides 60 are slid into the channels, spanning one or more modules and prepacs, therein holding together the assembled components. FIG. 12 is a cross-sectional view of an elongate internal slide taken along section line 12-12 of FIG. 11. The elongate internal slide 60 is a six sided bar that frictionally fits in a channel formed by parallel full rails, 14 and partial rails 15. In the FIG. 12, the rails are shown in ghost as indicated by dashed lines. The six sides are the following: a top 60*t*, a bottom 60*b*, an upper right side 60*ur*, a right underside 60*ru*, an upper left side 60*ul*, and a left underside 60*lu*. A right V notch is formed with the upper right side 60*ur* and the right underside 60*ru* meeting at a right vertex 30*rv* of the two right sides. A left V notch is formed with the upper left side 60*ul* and the left underside 60*lu* meeting at a left vertex 60*lv* of the two left sides. Most of the friction is generated as a result of the tightness of fit in the channel between the apex left 14*al* and the apex right 14*ar*, and the width of V notches between the right vertex 30*rv* and the left vertex 60*lv*. The bottom of the slide almost always clears the bottom of the channel 18.

Figure 9:
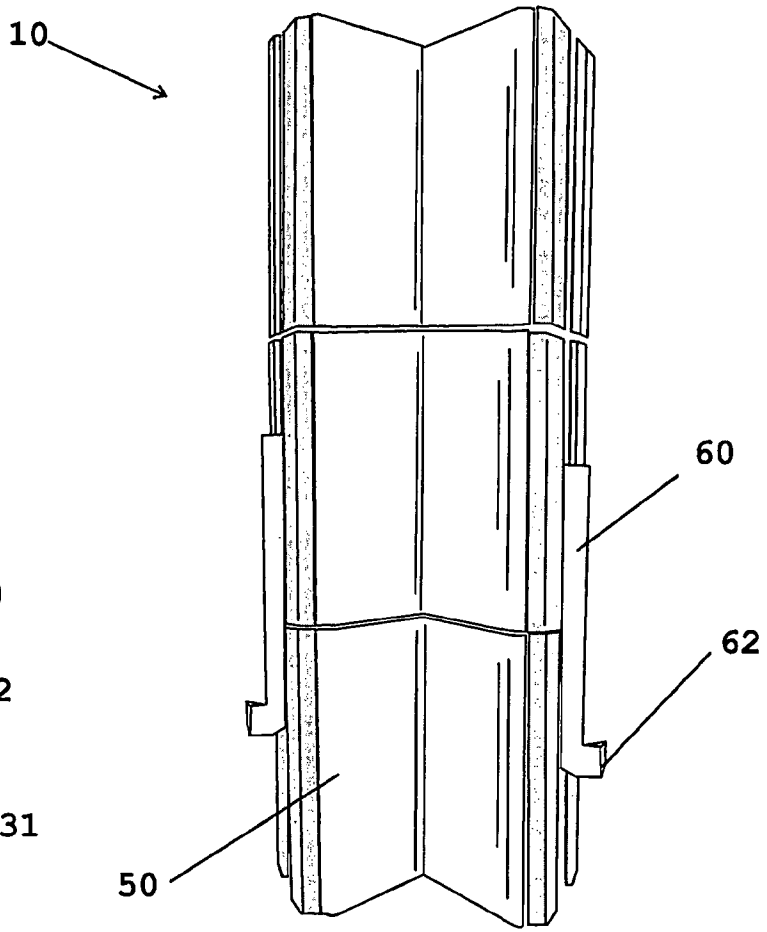
FIG. 9 is a bar-side view of a multi-module linear shape charge, where each of the three module is assembled utilizing flat pack quadrant panels. One of the panels is replaced with an angle bar, a pie shaped wedge of the explosive is removed therein imparting shape to the linear charge, and the individual modules are ganged linearly utilizing elongate slides, which are reversed such that the L-shaped extension on the end are projecting outward.
Figure 10:
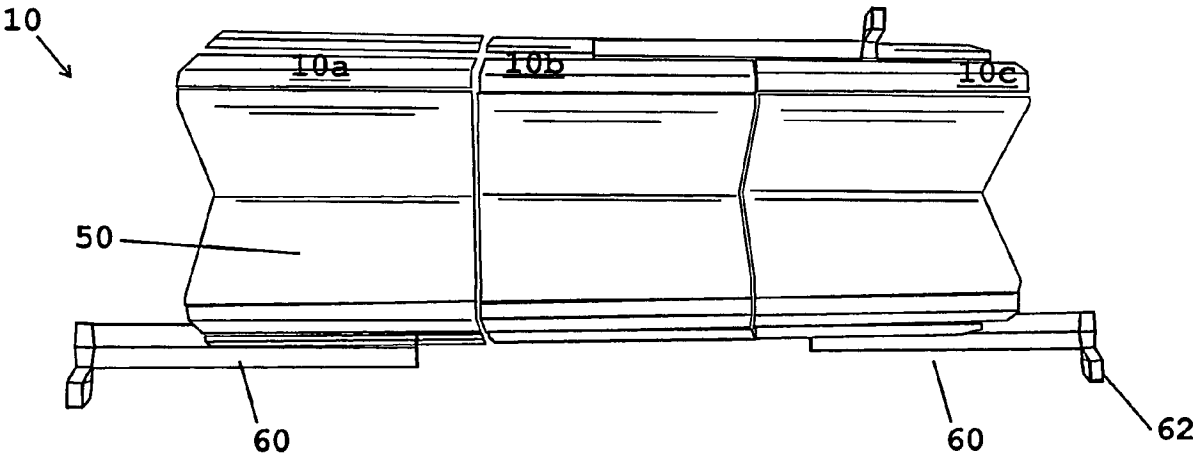
FIG. 10 is a bar-side view of the multi-module linear shape charge shown in FIG. 9, wherein the elongate internal slides are reversed such that the L-shaped extension on the end are projecting outward connecting the three module, and additional elongate internal slides extend from the linear shape charge, functioning to increase an overall length of span and to establish a standoff distance.

The right side is the mirror image of the left side, and the bottom side is the mirror image of the top side. With one exception, the symmetry allows the length of the elongate internal slide to be inserted in the channel 18 either upside down or up. The one exception is that one end of the slide has an L-shaped extension 62 that can be used to secure liners 40 (see FIG. 1), and explosive flying projectiles 80 (see FIG. 6). To secure elements to the front of a module, the L-shaped extension 62 are turned inward. To connect a series of modules, as shown in FIG. 9 and FIG. 10, where the series is longer than the slide 60, or to use the L-shaped extensions 62 as feet, the L-shaped extensions 62 are, usually turned outward. FIG. 10 illustrates the exception. The linear shape charge has three modules 10*a*,10*b*,10*c* connected using the slides. The connection between 10*a* and 10*b* is on the backside, and is not visible. The slides are also used to extend the working length of the module 10, frequently for establishing a stand-off distance. Additional modules also may be connected to lengthen the stand-off distance. FIG. 11 is an assemblage of views of an elongate internal slide illustrating potential positions of the elongate slides 60 having an end with an L-shaped extension 62.

In many applications, and as shown in FIG. 2, the full length of the conical liner 40 extends axially from the front edge 28' to the explosive charge 12. The illustrated liner 40 is relatively thin, just thick enough to protect the explosive charge. The prepac explosive 12 may be combined with a hand packed explosive, such that the hand packed explosive is packed around the liner 40. The shape of the liner determines the shape of the hand packed charge. A conical liner produces a conical shape hand packed charge. When detonated, the liner is generally focused into a hot molted ball that is rapidly but partially oxidized. Since the oxidation is exothermic, the liner itself may contribute energy to the charge. Examples of exothermic liners include copper, magnesium, and aluminum. Glass and other ceramics are sometimes used to generate a different effect.

Figure 6:
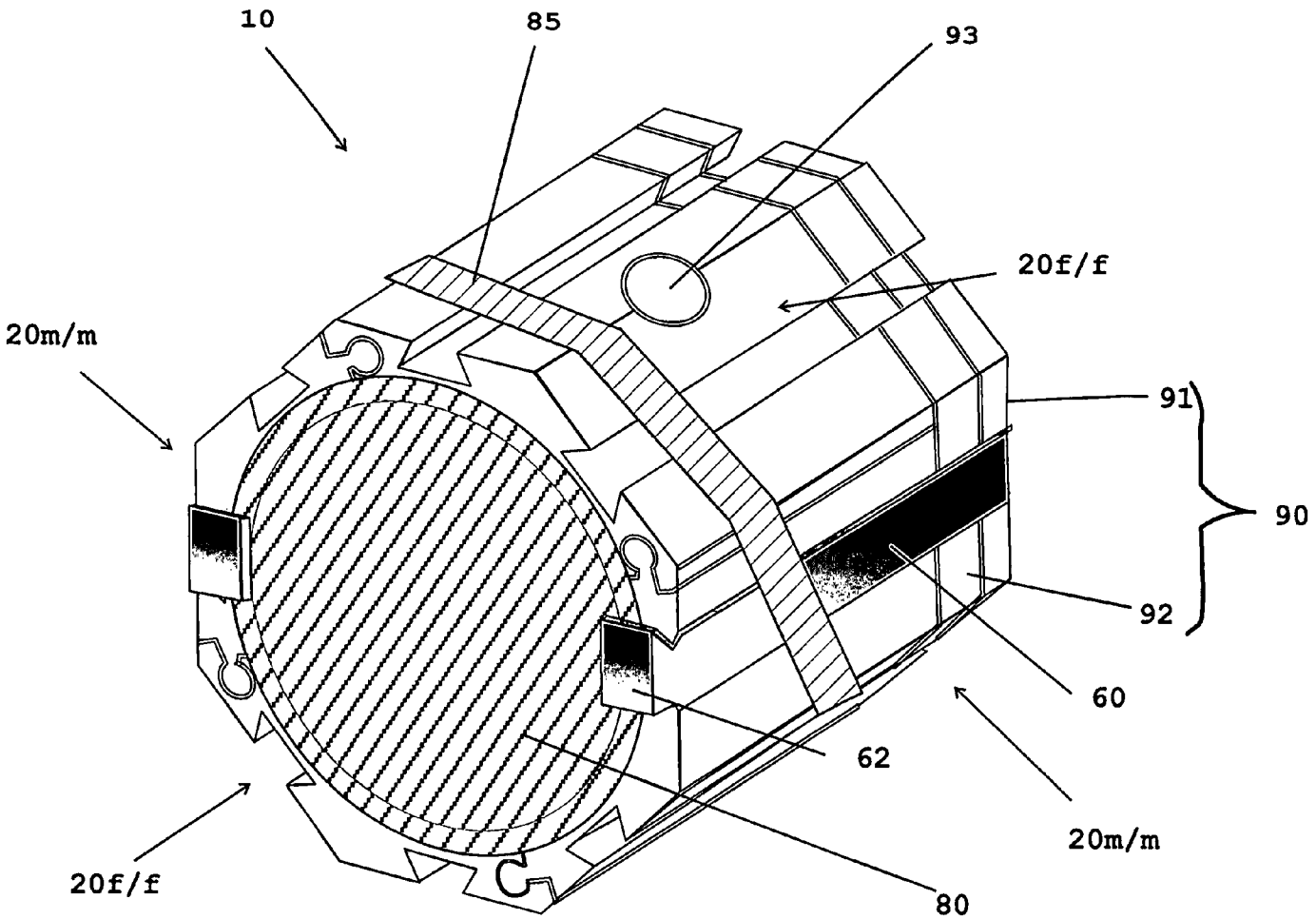
FIG. 6 is a perspective elevated view of a variation in the hardware of the modular charge system, where the hardware includes a flyer plate fitted on a module having a prepac.

Referring to FIG. 6, which is a perspective elevated view of a variation in the hardware, where the hardware includes a flyer plate 80 fitted on a module 10 having an explosive prepac 90 with a cylindrical retainer 92, an explosive (not visible) and a rear plate 91. The flyer plate 80 may be made of iron, copper, aluminum, magnesium, other metals and alloys thereof. The elongate slides 60 are taped into position using a suitable tape, for example a polyimide film pressure sensitive adhesive tape 85. Taping may be necessary if the flyer plate 80 is heavy. The single module, in an exemplary embodiment, contains an explosive. The top panel female/female panel 20*f/f* has a panel access port 93 for a receptacle 86 and an igniter 84 as shown in FIG. 7. The panel access port 93 also may be used to mount a module in a stand, such as tripod. Tripods are used to establish an optimum stand-off distance. See FIG. 7 for an example of a receptacle 86 and an igniter 84. The panel access port 93 is similar to the access port 94 in the rear plate 91 in the prepac 90 illustrated in FIG. 1.

Figure 5:
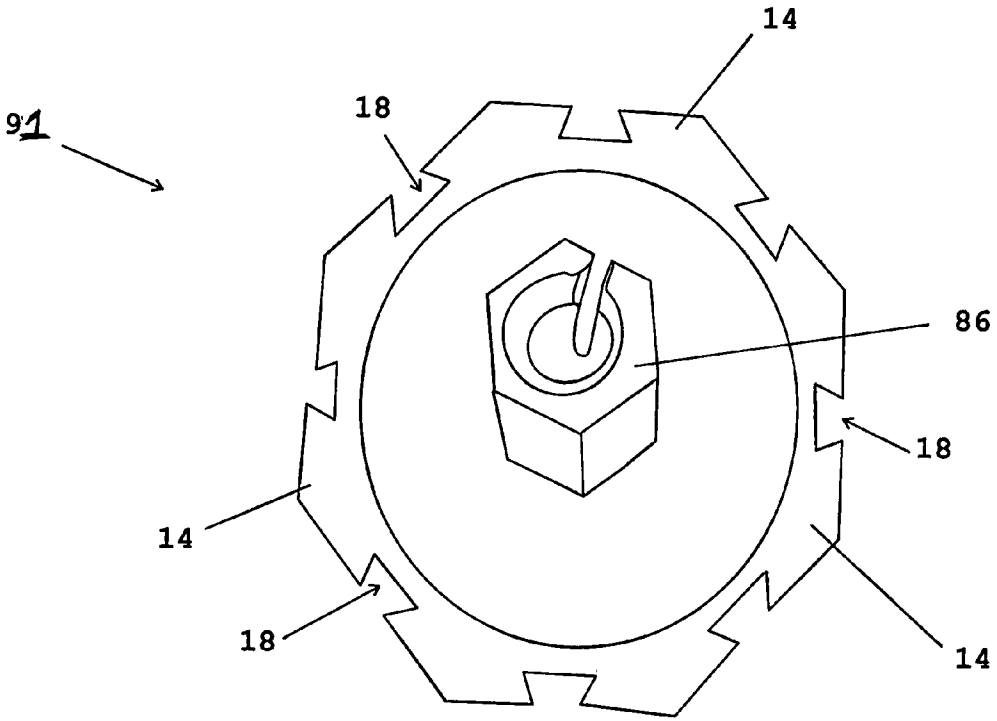
FIG. 5 is a perspective elevated view of the rear plate with rails, where the access port for the actuator is fitted with a receptacle that may receive an appropriate plug assembly, electric and non-electric blasting caps, and modern initiators.

FIG. 5 is a perspective elevated view of the rear plate 91 with rails 14 and channels 18, where the access port 94 (see FIG. 1) for the receptacle 86 may receive an igniter 84, including appropriate plug assembly, electric and non-electric blasting caps, and modern initiators.

The disclosed invention is highly suited for explosive ordnance disposal performed using dismounted operations. Dismounted operations require that potentially everything to be carried, manually, for instance in a backpack. The system is advantageous in that the explosive is already packed in standard modules where it may be configured into multiple explosive devices. Hand packing the explosive is usually not required, just the addition of prepacs or cutting out a wedge of explosive.

The invented system condenses and consolidates the capabilities available from multiple explosives and explosive tools into substantially one relatively lightweight device suitable for dismounted operations.

Examples of varieties of explosive that are in common use in shape charges include cyclotrimethylene-trinitramine (RDX), cyclotetramethylenetetranitramine (HMX), pentaerythritol-tetranitrate (PETN), hexanitrostilbene (HNS), and dipicramide (DiPam).

Cyclotrimethylenetrinitramine (RDX), a colorless explosive, is usually dyed pink for use in LSCs. RDX must be highly purified to insure stability at higher temperatures. Most LSCs contain RDX. Cyclotetramethylenetetranitramine (HMX) is very similar to RDX. HMX is white to colorless. It may be used at higher temperatures than RDX. Pentaerythritoltetranitrate (PETN) is less powerful and more sensitive than RDX. PETN is used primarily in detonators, but may be used in LSCs. Dipicramide (DiPam) is a new explosive that it is less brisant and less sensitive than RDX. Hexanitrostilbene (HNS) also is a new explosive, which has been for high temperature applications.

As previously noted, in an exemplary embodiment, the explosive C4 is substantially RDX with a plastic binder (usually polyisobutylene), a plasticizer (usually dioctyl sebacate or dioctyl adipate), sometimes with a motor oil, and usually has a marker or odorizing taggant chemical such as 2,3-dimethyl-2,3-dinitrobutane (DMDNB).

Shock tubing, or detonation chord, is generally favored, but the choice is influenced by the mission and the selection of the explosive. The modules also may use plastic bags for cushioning removed explosive and storing water based liquids.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An assemblable module charge system, comprising:

a set of quadrant panels, where an individual quadrant panel is a fractional component of a cylindrical wall with a plurality of external longitudinal rails, which are parallel and separated by channels, wherein the fractional component of the cylindrical wall includes a sectional length with the fastening side edges, wherein the set of quadrant panels is storable as a flat-pack and assembleable to form a single module for a reduction in volume, wherein both said fastening side edges of the quadrant panel are attached to another said fastening side edge of at least one adjacent panel, and wherein the flat-pack is a group of unassembled quadrant panels nested to minimize space;

least one elongate slides being frictionally positioned in a channel; and a charge system.

2. The assemblable module charge system according to claim 1, wherein the charge system is a prepac, wherein the prepac is one of an explosive and a combination of explosives prepackaged in a cylindrical retainer and a rear plate, wherein both the cylindrical retainer and the rear plate include a plurality of external longitudinal rails, which are parallel and separated by channels, wherein the prepac and the plurality of external longitudinal rails are aligned with the plurality of external longitudinal rails located on the single module, which is assembled module, and wherein a plurality of the elongate slides are positioned to span from the prepac to the single module.

3. The assemblable module charge system according to claim 2, wherein the flat pack is comprised of at least two male/male quadrant panels and at least two female/female quadrant panels.

4. The assemblable module charge system according to claim 2, wherein the prepac comprises an explosive with a circular mass of C-4 wrapped in at least one coiled segment of detonation chord.

5. The assemblable module charge system according to claim 1, wherein each of the plurality of the external longitudinal rails is comprised of an upper left side, a upper right side, a left under side, a right under side, and a bottom, which is contiguous with a perimeter wall of the cylindrical wall, wherein said upper left side and said upper right side intersect forming an apical edge, and wherein said left under side and said right under side of each of the plurality of external longitudinal rails are undercut so that each side forms a sloped undercut surface.

6. The assemblable module charge system according to claim 1, further comprising a liner being inserted into the single module and being held in position by said at least one elongate slides, wherein said at least one elongate slides includes L-shaped extensions.

7. An assemblable module charge system, comprising:

a set of quadrant panels, where an individual quadrant panel is a fractional component of a cylindrical wall with a plurality of external longitudinal rails, which are parallel and separated by channels, wherein the fractional component of the cylindrical wall includes a sectional length with fastening side edges, wherein the set of quadrant panels is storable as a flat-pack and assembleable into a single module for reduction in volume, wherein both fastening side edges of the quadrant panel are attached to another side edge of at least one adjacent panel, and wherein the flat-pack is a group of unassembled quadrant panels nested to minimize space;

an angle bar being bent for forming two sides, wherein each of the side includes an edge; and a charge system comprising an explosive, wherein a modular linear shape charge is comprised of the angle bar situated in the single module, which includes the explosive, and wherein the explosive is a three quarter pie shaped explosive.

8. The assemblable module charge system according to claim 7, wherein a larger linear shape charge is comprised of a plurality of modular linear shape charges, which are in continuous contact, and connected together by at least one elongate slide frictionally positioned in a channel.

* * * * *